US005118014A

United States Patent [19]

Hestehave et al.

[11] Patent Number: 5,118,014

[45] Date of Patent: Jun. 2, 1992

[54] SPILL-PROOF MUG

[75] Inventors: Borge Hestehave, Alta Loma; Kenneth E. Holmes, Huntington Beach, both of Calif.

[73] Assignee: Bomatic, Inc., Ontario, Calif.

[21] Appl. No.: 609,520

[22] Filed: Nov. 5, 1990

[51] Int. Cl.[5] ..... A47G 19/22

[52] U.S. Cl. ..... 222/472; 222/485; 222/509; 222/518; 220/254; 220/715

[58] Field of Search ..... 222/508, 509, 511, 517, 222/518, 470, 472, 473, 556, 463, 478, 481, 482, 483, 484, 485, 486; 220/90.4, 90.2, 254

[56] References Cited

U.S. PATENT DOCUMENTS

| | | | |
|---|---|---|---|
| 2,447,870 | 8/1948 | Polcyn | 220/254 X |
| 3,396,876 | 8/1968 | Workman et al. | 222/509 X |
| 3,847,311 | 11/1974 | Flores et al. | 222/518 X |
| 3,972,443 | 8/1976 | Albert | 222/511 X |
| 4,094,433 | 6/1978 | Numbers | 222/511 X |
| 4,099,642 | 7/1978 | Nergard | 222/518 X |
| 4,121,731 | 10/1978 | Okerstrum | 220/90.4 |
| 4,133,446 | 1/1979 | Albert | 222/509 X |
| 4,212,408 | 7/1980 | Valenzona | 222/518 X |
| 4,276,992 | 7/1981 | Susich | 220/254 |
| 4,303,173 | 12/1981 | Nergard | 222/470 X |
| 4,712,704 | 12/1987 | Ramsey et al. | 222/518 X |

*Primary Examiner*—Michael S. Huppert
*Assistant Examiner*—Kenneth DeRosa
*Attorney, Agent, or Firm*—Sixhbey, Friedman, Leedom & Ferguson

[57] ABSTRACT

A spill-proof drinking mug for drinking using either left or right hands of the user in which a base part serving as a container for the liquid is provided with a shape designed to fit within conventional cup holders of vans and RV's as well as cup-holding attachment for automobiles, and which has a threaded top opening. A screw-on cap with a handle sealingly mates with the top opening of the vessel, and has a pair of drinking openings at opposite sides of the handle. One opening is used for drinking and the other serves as a vent. A spring-loaded valve is mounted on the cap and is operable by the thumb of the hand holding the handle to simultaneously displace the valve out of both openings.

14 Claims, 4 Drawing Sheets

FIG. 5
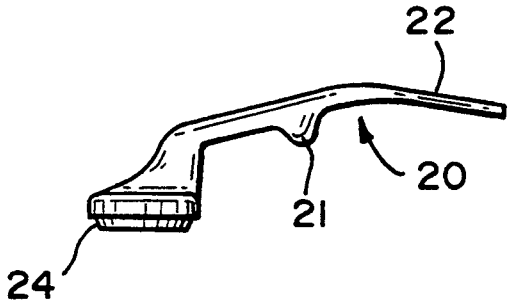
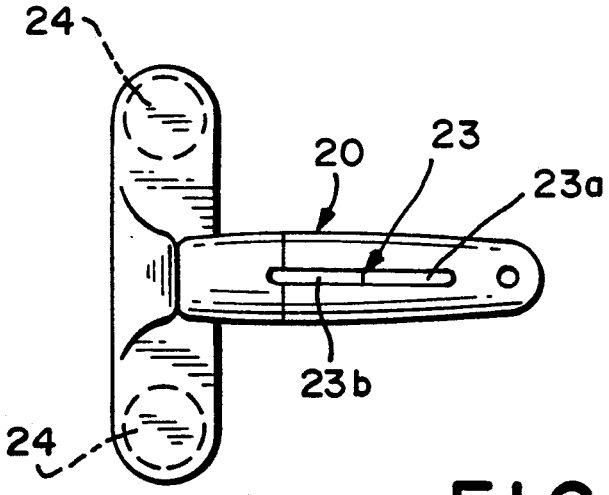
FIG. 6

FIG. 7
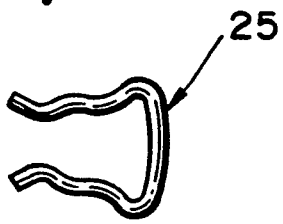
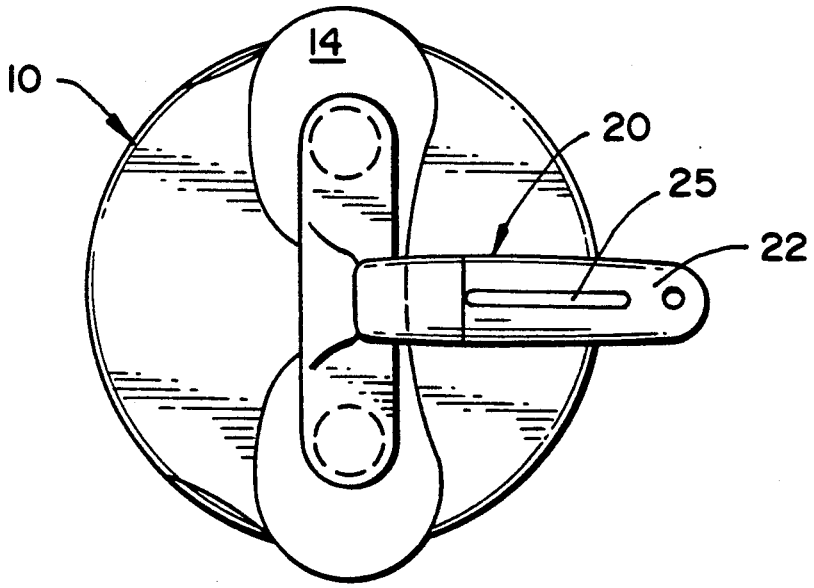
FIG. 8

SPILL-PROOF MUG

BACKGROUND OF THE INVENTION

1. Field of the Invention

The present invention relates to drinking mugs and cups that are provided with a closure to prevent spilling of the contents, such as when used during traveling in a vehicle. More .specifically, the invention is directed to such a mug or cup when a closure valve is provided to control dispensing of the contents of the cup or mug.

2. Related Art

A drinking cup with a laterally actuated valve is known from U.S. Pat. No. 4,276,992, in which a drinking cup is provided with a cover for closing its top opening. This cover is secured to the cup by a bayonet-type connection and has an opening through which the contents of the cup may be dispensed. To prevent spillage through the opening of the cover, a spring-loaded valve is mounted on the cover, and this valve is designed to be operable by the thumb of a hand holding the handle of the cup. However, because the opening of the cover is positioned at a 90 degree angle with respect to the handle of the cup, a left-handed person cannot use a cup and cover assembly that is designed right-handed users and vice versa. Furthermore, the provision of only the one valved opening does not insure effective venting of the cup interior during dispensing of its contents, resulting in potential surges as air is vented in through the single opening, due to the creation of a partial vacuum as the contents are discharged from the opening, a characteristic which can have unpleasant consequences, particularly when the cup contains a hot beverage.

In U.S. Pat. No. 4,121,731, a top enclosure for children's drinking vessels is shown which has a pair of handles, one at 90 degrees clockwise and one at 90 degrees counterclockwise relative to the drinking opening of the top enclosure. However, this device is designed so that one can "drink from the drinking vessel only when the handles on opposing sides of the vessel are depressed," so that the contents will not spill if the vessel drops on the floor and lands on a handle. However, besides the awkwardness and unattractiveness of having two handles, such a drinking vessel does not permit one-handed use, whether it be right-handed or left-handed, and thereby is unsuitable for adult usage.

Thus, there is a need for a spill-proof drinking mug which has a valved drinking opening which can be used in one hand and is not limited to use by a specific hand of the user.

SUMMARY OF THE INVENTION

In view of the foregoing, it is a primary object of the present invention to provide a spill-proof drinking mug which has a valved drinking opening which can be used in one hand and is not limited to use by a specific hand of the user.

It is a further object of the present invention to achieve the preceding object while also providing for efficient venting of the interior of the mug.

Yet another object of the present invention is to enable a drinking mug having the above-mentioned attributes to be achieved economically and in a manner adapted to vehicular use.

These and other objects are achieved in accordance with a preferred embodiment of the invention in which a base part serving as a container for the liquid is provided with a shape designed to fit within conventional cup holders of vans and RV's as well as cup-holding attachment for automobiles, and which has a threaded top opening. A screw on cap with a handle sealingly mates with the top opening of the vessel, and has a pair of drinking openings at opposite sides of the handle. One opening is used for drinking and the other serves as a vent. A spring-loaded valve is mounted on the cap and is operable by the thumb of the hand holding the handle to simultaneously displace the valve out of both openings.

These and other objects, features and advantages of the invention will become apparent from the following detailed description when viewed in conjunction with the accompanying figures of the drawings.

BRIEF DESCRIPTION OF THE DRAWINGS

FIGS. 5 and 6, respectively, are side elevational and top plan views of a valve member of a valve assembly for the screw-on cap of FIGS. 3 and 4.

FIG. 7 is a wire clip for the valve member of FIGS. 5 and 6.

FIG. 8 is a top plan view of the screw-on cap with the valve assembly in place.

DETAILED DESCRIPTION OF THE PREFERRED EMBODIMENTS

Figure 1:
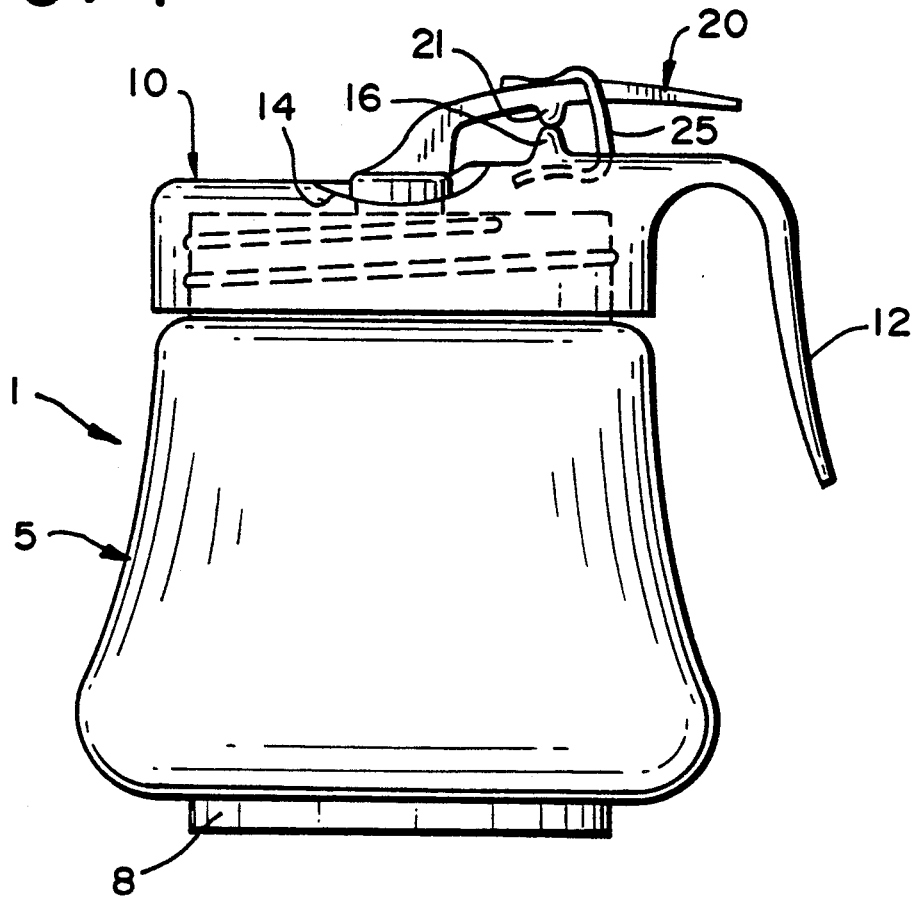
FIG. 1 is a side elevational view of a drinking mug in accordance with a preferred embodiment of the invention.

In FIG. 1, a preferred embodiment of a spill-proof drinking mug in accordance with the present invention is shown, and designated generally by reference numeral 1. However, it is noted that the invention is referred to herein as a "mug" merely because it is a conveniently short term for identifying a handled drinking vessel, and use of this term should not be construed to mean that the present invention is limited to a specific type of drinking cup or vessel.

Figure 2:
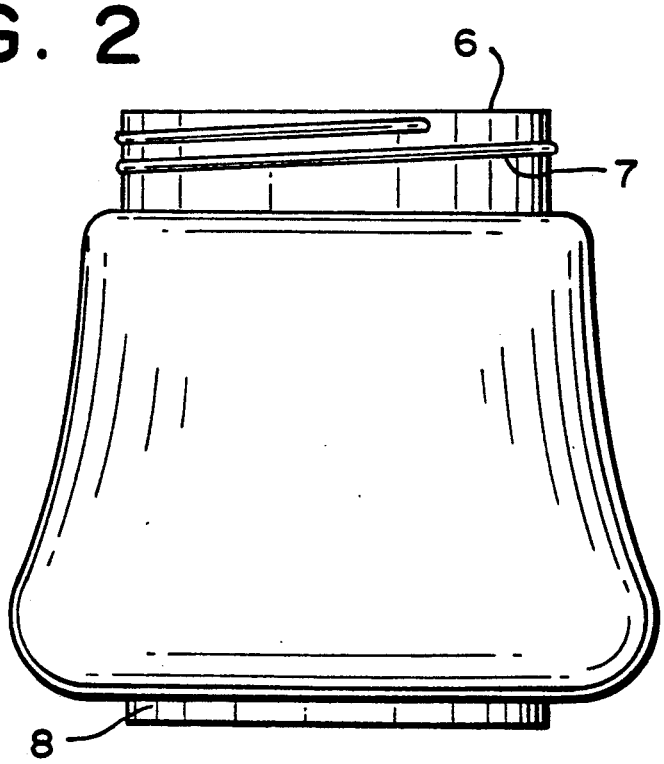
FIG. 2 is a side elevational view of the vessel portion of the FIG. 1 mug.

The mug 1 has two primary parts, a base part 5 (which serves as a container for a beverage) and a cap 10. As can be seen from FIG. 2, base part 5 has a top opening 6 which is provided with an external screw thread 7 for attachment of cap 10. Additionally, base part 5 has a rounded, generally frusto-conical shape which not only gives the mug 1 a low center of gravity to minimize any tendencies to tip (such as when a vehicle in which it is resting turns or stops), but also provides an attractive appearance. Still further, the bottom of the base part 5 is provided with a cylindrical formation 8 which will fit into conventional cup holders as are found in vans and RV's as well as automobile cup-holding attachments.

Figure 3:
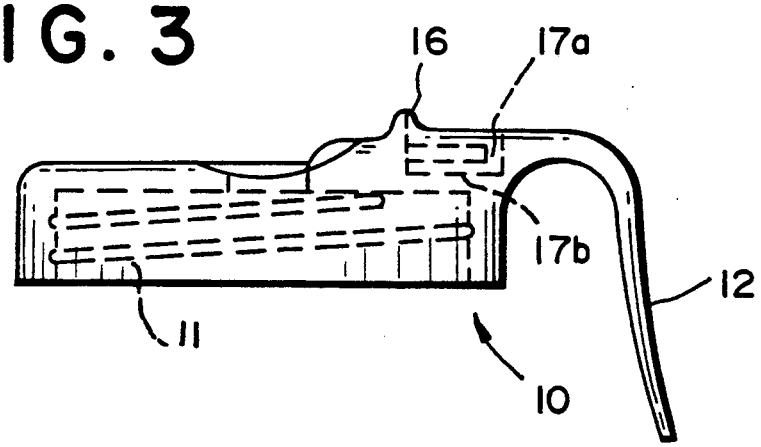
FIG. 3 is a side elevational view of the screw-on cap of the FIG. 1 mug prior to attachment of a spring-loaded valve assembly.

Cap 10 has an internal thread 11 (FIG. 3) which mates with screw thread 7 of base part 5 for attachment of the cap to it. However, other know forms of securement, such as bayonet-type connections could be used instead. To avoid having to take any special steps to insure a proper positional relationship between a handle of the mug and drinking openings of the cap, the handle 12 for holding the mug 1 is formed as an integral part of the cap 10. To enable drinking of liquids contained in the base part 5 when the mug is held with handle 12 in either the right or the left hand, a pair of drinking openings 13 are provided. These openings 13 connect with recessed areas 14 that are formed in the top surface 15 of the cap 10.

Figure 4:
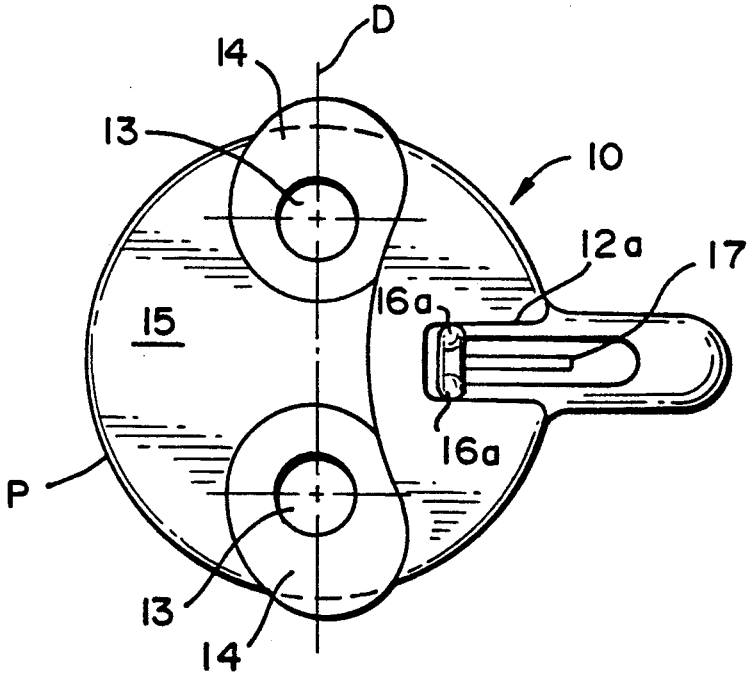
FIG. 4 is a top plan view of the screw-on cap as shown in FIG. 3.

The recessed areas 14 have an arcuate shape which curves about a transverse diameter D of the cap and forms a channel for flow radially outwardly from each drinking opening 13. Furthermore, as can be seen in FIG. 4, each recess 14 terminates, at its outer end, in a lip-like overhang that extends beyond the perimeter P of the internally threaded body portion of the cap 10. In this way, the recessed areas facilitate drinking from the mug in a moving vehicle without "dribbling" type spillage.

Finally, cap 10 is provided with a pivot bearing 16 for a valve member 20 (FIGS. 5, 6) and a through-slot 17 for a spring clip 25 (FIG. 7), of a valve assembly that controls opening and closing of the drinking openings 13. Pivot bearing 16 is integrally formed on top of an inner extension 12*a* of the handle 12, and may have a pair of spheric or cylindric recesses 16*a* for receiving complementary pivot rubs of a pivot bearing portion 21 formed on the actuating lever 22 of the valve member 20. The slot 17 comprises a vertical opening portion 17*a* and a horizontally undercut portion 17*b* which extends in a radially inward direction from a point outwardly of bearing 16 to a point inwardly thereof.

A similar spring slot 23 is formed in the actuating lever 22, and is formed of a through-slot 23*a* and a receiving notch or recess 23*b*. The spring clip 25 is generally C-shaped and, as is recognizable from FIG. 1 has one leg passed engaged within portion 17*b* of cap 10 and the other leg in recess 23*b*, with its cross piece extending through slot 23*a* and opening portion 17*a*, thereby applying a holding force which clamps the pivot bearing 16 against pivot bearing portion 21, and applies a moment acting on the actuating lever in a counterclockwise direction as viewed in FIG. 1. In this way, the spring clip holds the actuating lever in a closed position in which frusto-conic valve elements 24 are sealingly engaged in openings 13. While spring clip 25 applies sufficient force to prevent inadvertant spillage, it is weak enough to comfortably enable thumb pressure applied to the end of actuating lever 22 to produce a clockwise swinging of the lever 22 about the pivot against the spring force, thereby removing the valve members from the openings 13.

Once the valve elements 24 have been extracted from the openings, by tilting the mug 1, fluid will flow out one of the openings, along the channel formed by a recess 14, and into the users mouth. At the same time, air is able to flow into the fluid containing space of the base part 5 through the other opening 13, thereby preventing the formation of a partial vacuum and any associated surging effect.

The base part 5, cap 10 and valve member 20 are all formed of a synthetic plastic material, such as PVC. The base part 5 can be formed by either blow molding or injection molding, while the cap 10 and valve member 20 are injection molded. The spring clip 25 is made of a bent piece of metal wire.

Those of ordinary skill in the art will recognize that, while the above represents a preferred embodiment, numerous changes and modifications can be made without departing from the basic teachings of this invention, such as by modifying the shape of the base part and changing the shape of the drinking openings, etc. Thus, the present invention should not be considered to be limited to the above-described features and is intended to encompass the full scope of the appended claims.

We claim:

1. Spill-proof mug comprising: a hollow base part which forms a fluid container; a handle by which said mug is holdable in one hand of a user; a cap for closing a top opening of the base part having means for securing the cap to the base part and a pair of drinking openings; and valve means carried by said handle; wherein one of said drinking openings is located at each side of said handle; and said valve means is spring-loaded into a normal position closing said openings and is shiftable from said normal position into an open position allowing fluid to flow from said fluid container via one of said openings while air is allowed to enter via the other of said openings as a means for drinking using either left or right hands of the user;

wherein said handle is carried by said cap;

wherein said valve means comprises a pivotable actuating lever having a pair of valve elements, said valve means being pivotally mounted on an inner extension of the handle, a spring clip engaging said cap and said lever for swinging said lever into said normal position, in which the valve elements engage in said openings; and wherein one end of said spring clip engages said actuating lever on a first side of a pivot bearing means for pivotally mounting said actuating lever; wherein a cross piece of said spring clip passes through a slot formed in said actuating lever on an opposite side of said pivot bearing means; and wherein an opposite end of said cap engages in an undercut slot in said cap.

2. Spill-proof mug according to claim 1, wherein each of said openings is formed in the bottom of an arcuate channel-forming recess that runs radially outwardly in a lateral direction relative to said handle.

3. Spill-proof mug according to claim 2, wherein each said recess terminates on a lip like overhang that extends outwardly beyond the perimeter of a portion of the cap containing said means for mounting.

4. Spill-proof mug according to claim 3, wherein said means for mounting comprises an external screw thread on said base part and a complementary internal screw thread formed on said cap.

5. Spill-proof mug according to claim 1, wherein said means for mounting comprises an external screw thread on said base part and a complementary internal screw thread formed on said cap.

6. Spill-proof mug comprising: a hollow base part which forms a fluid container; a handle by which said mug is holdable in one hand of a user; a cap for closing a top opening of the base part having means for securing the cap to the base part and a pair of drinking openings; and valve means carried by said handle; wherein one of said drinking openings is located at each side of said handle; and said valve means is spring-loaded into a normal position closing said openings and is shiftable from said normal position into an open position allowing fluid to flow from said fluid container via one of said openings while air is allowed to enter via the other of said openings as a means for drinking using either left or right hands of the user; and wherein each of said openings is formed in the bottom of an arcuate channel-forming recess that runs radially outwardly in a lateral direction relative to said handle.

7. Spill-proof mug according to claim 6, wherein each said recess terminates on a lip-like overhand that extends outwardly beyond the perimeter of a portion of the cap containing said means for mounting.

8. Spill-proof mug according to claim 7, wherein said means for mounting comprises an external screw thread on said base part and a complementary internal screw thread formed on said cap.

9. Spill-proof mug according to claim 6, wherein said handle is an integrally formed part of said cap.

10. Spill-proof mug according to claim 6, wherein a cylindric mounting base is formed on the bottom of the base part as a means for mounting the mug in a cup receptacle.

11. Spill-proof mug comprising: a hollow base part which forms a fluid container; a handle by which said mug is holdable in one hand of a user; a cap for closing a top opening of the base part having means for securing the cap to the base part and a pair of drinking openings; and valve means carried by said handle; wherein one of said drinking openings is located at each side of said handle; and said valve means is spring-loaded into a normal position closing said openings and is shiftable from said normal position into an open position allowing fluid to flow from said fluid container via one of said openings while air is allowed to enter via the other of said openings as a means for drinking using either left or right hands of the user;

wherein said valve means comprises a pivotable actuating lever having a pair of valve elements, said valve means being pivotally mounted on a portion of the cap, a spring clip engaging said cap and said lever for swinging said lever into said normal position, in which the valve elements engage in said openings; and wherein one end of said spring clip engages said actuating lever on a first side of a pivot bearing means for pivotally mounting said actuating lever; wherein a cross piece of said spring clip passes through a slot formed in said actuating lever on an opposite side of said pivot bearing means; and wherein an opposite end of said cap engages in an undercut slot in said cap.

12. Spill-proof mug comprising: a hollow base part which forms a fluid container; a handle by which said mug is holdable in one hand of a user; a cap for closing a top opening of the base part having means for securing the cap to the base part and a pair of drinking openings; and valve means carried by said handle; wherein one of said drinking openings is located at each side of said handle; and said valve means is spring-loaded into a normal position closing said openings and is shiftable from said normal position into an open position allowing fluid to flow from said fluid container via one of said openings while air is allowed to enter via the other of said openings as a means for drinking using either left or right hands of the user;

wherein said valve means comprises a pivotable actuating lever having a pair of valve elements, said valve means being pivotally mounted on a portion of the cap, a spring clip engaging said cap and said lever for swinging said lever into said normal position, in which the valve elements engage in said openings; and wherein said cap and said lever are formed of a molded synthetic plastic material, said pivot bearing means comprising a pivot bearing integrally molded as part of said cap and a pivot bearing portion integrally molded as part of said actuating lever, said pivot bearing and pivot bearing portion being formed with complementary arcuate surfaces which are held in engagement with each other by said spring clip and which form means for enabling the actuating lever to pivot on the cap.

13. Spill-proof mug according to claim 12, wherein said handle is an integrally formed part of said cap.

14. Spill-proof mug according to claim 12, wherein a cylindric mounting base is formed on the bottom of the base part as a means for mounting the mug in a cup receptacle.

* * * * *